United States Patent [19]

Kingham

[11] Patent Number: 4,860,518

[45] Date of Patent: Aug. 29, 1989

[54] FIXTURE AND METHOD OF LAYING SHINGLES ON THE SURFACE OF A ROOF OR VERTICAL WALL

[76] Inventor: James R. Kingham, 226 Rutgers Ave., Swartmore, Pa. 19081

[21] Appl. No.: 183,386

[22] Filed: Apr. 13, 1988

Related U.S. Application Data

[63] Continuation-in-part of Ser. No. 81,770, Aug. 14, 1987, abandoned.

[51] Int. Cl.[4] ..... E04D 15/02

[52] U.S. Cl. ..... 52/748; 52/749; 182/45

[58] Field of Search ..... 52/747, 749, 748; 33/648; 182/45

[56] References Cited

U.S. PATENT DOCUMENTS

| | | | |
|---|---|---|---|
| 26,386 | 12/1859 | VanDeusen . | |
| 54,584 | 5/1866 | Newbank . | |
| 59,626 | 11/1866 | Mourland . | |
| 231,836 | 8/1880 | Mills . | |
| 253,816 | 2/1882 | Clark | 33/648 |
| 386,329 | 7/1888 | Luce & Beckwith . | |
| 421,746 | 2/1890 | Mooney . | |
| 473,098 | 4/1892 | Underwood . | |
| 652,256 | 6/1900 | Farmer . | |
| 704,648 | 7/1902 | Knight . | |
| 774,114 | 11/1904 | Spear . | |
| 786,710 | 4/1905 | Anderson | 33/648 |
| 852,141 | 4/1907 | Sebree | 182/45 |
| 977,715 | 12/1910 | Dougherty . | |
| 1,047,613 | 12/1912 | Brown . | |
| 1,380,485 | 6/1921 | Langeberg . | |
| 1,504,635 | 9/1924 | McCausland . | |
| 1,750,854 | 3/1930 | Nelson . | |
| 1,941,404 | 12/1933 | Lansing . | |
| 1,989,141 | 1/1935 | Leonard | 33/648 |
| 2,715,780 | 8/1955 | Hageman | 52/748 |
| 2,716,288 | 8/1955 | Geddis . | |
| 2,814,533 | 11/1957 | Van Horn | 182/45 |
| 2,889,632 | 6/1959 | Longhi . | |
| 2,891,318 | 6/1959 | Harrison et al. . | |
| 3,495,373 | 2/1970 | White | 52/748 |

*Primary Examiner*—John E. Murtagh

*Attorney, Agent, or Firm*—Panitch Schwarze Jacobs & Nadel

[57] ABSTRACT

Fixture and method for laying shingles on the surface of a roof or vertical wall wherein the fixture comprises a pair of L-section rails and a L-section shingle support member. The shingle support member is secured to a pair of arms which are swingably mountable on the rails at spaced slots therealong. The shingle support member may be secured to the arms in either of two orientations. In one orientation, one leg of the shingle support member provides an abutment surface for supporting the bottom edges of a row of thin pliable shingles and another leg provides a surface for partially supporting the pliable shingles from below. In another orientation, only one leg of the shingle support member is used to provide an abutment surface for supporting the bottom edge of a row of thick rigid shingles, without supporting the shingles from below. Either or both rails may be color coded to facilitate laying rows of shingles on both sides of a roof obstacle with perfect uniformity of spacing between the bottom edges of adjacent rows. A spring device may be used to bias the shingle support member towards a vertical wall. Another spring device may be secured to the shingle support member to retain the shingles against the vertical wall.

33 Claims, 8 Drawing Sheets

FIG. 1
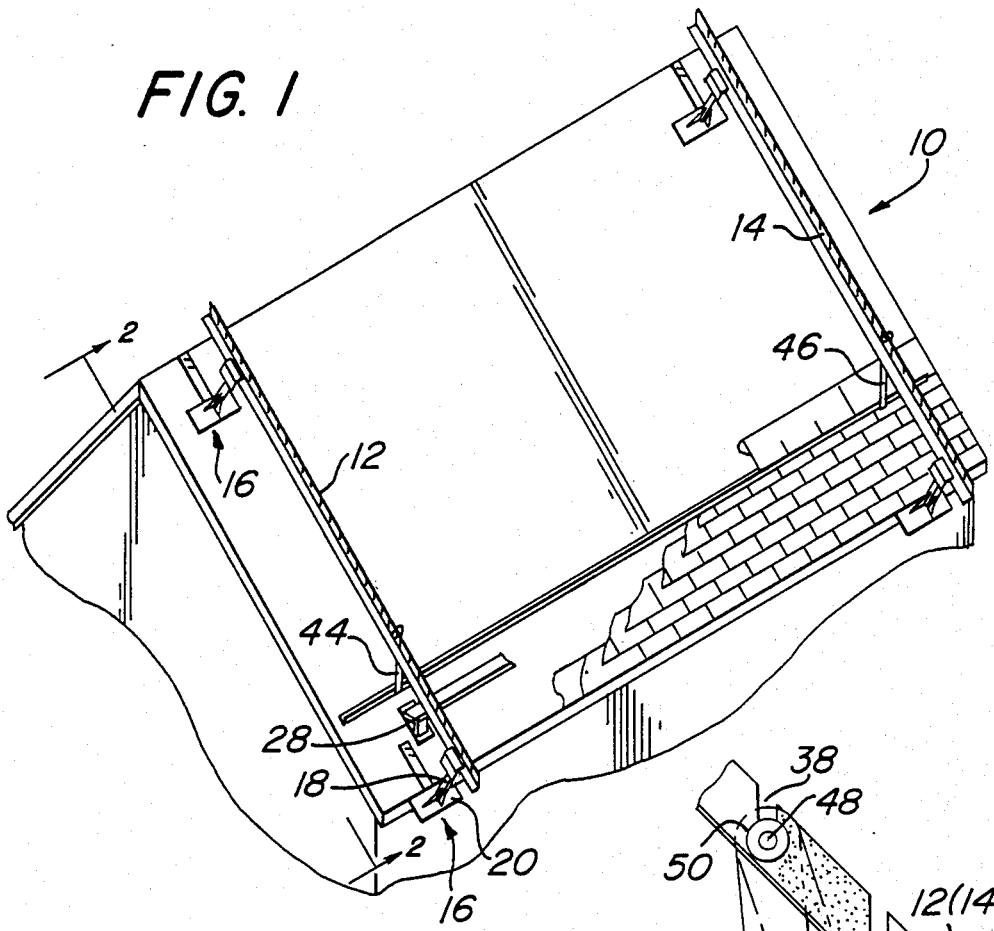
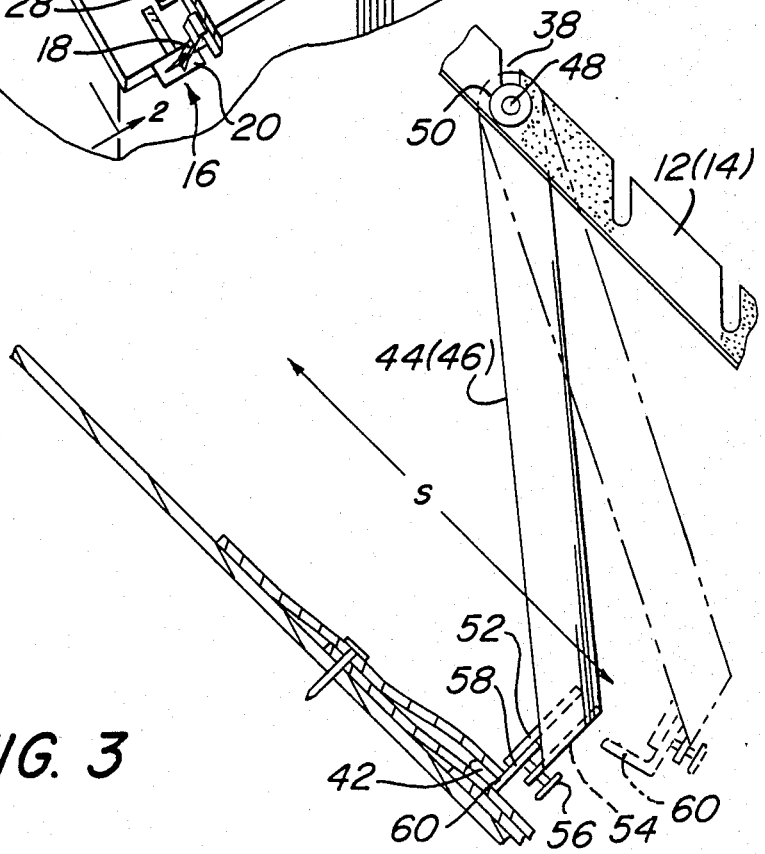
FIG. 3

FIG. 4
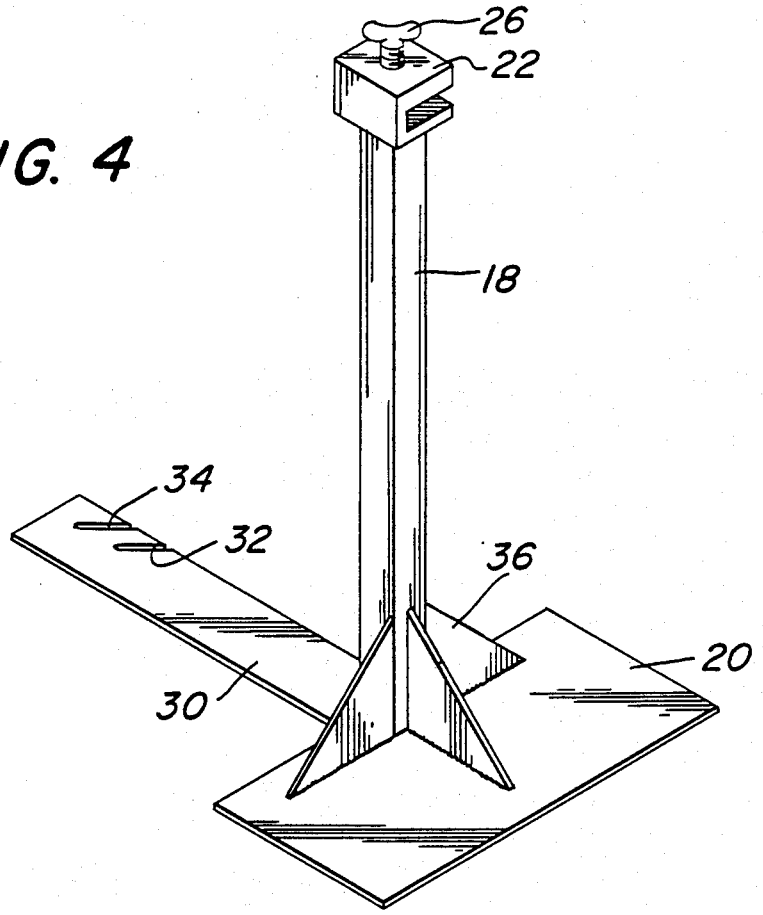
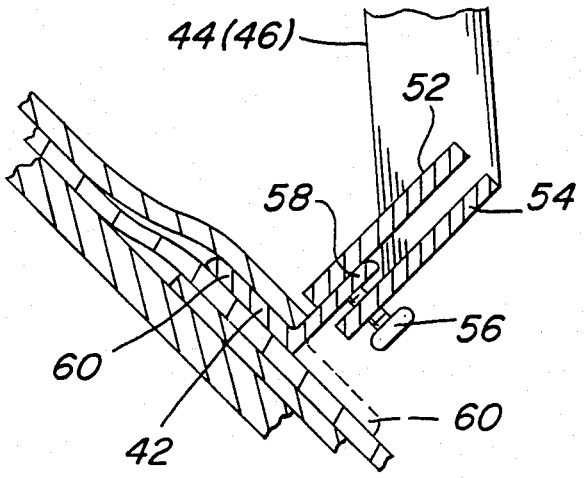
FIG. 5

FIG. 17
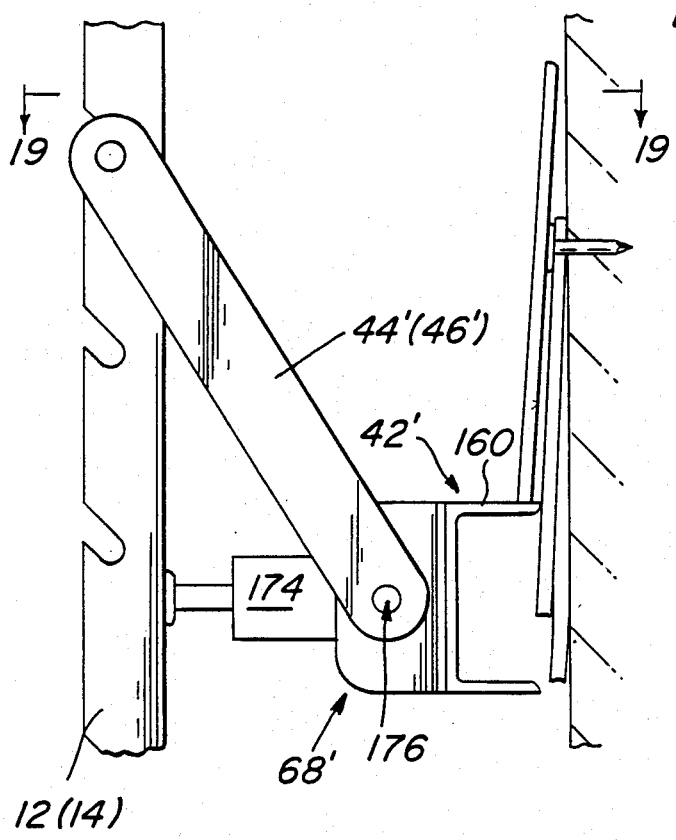
FIG. 18
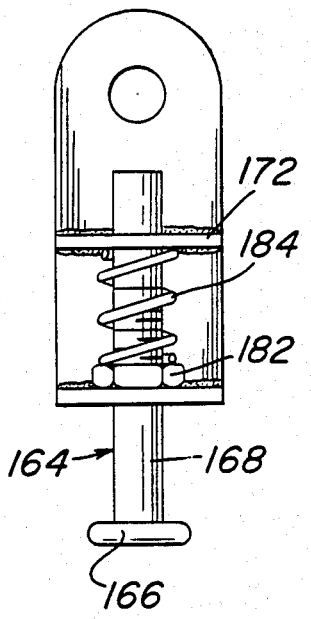
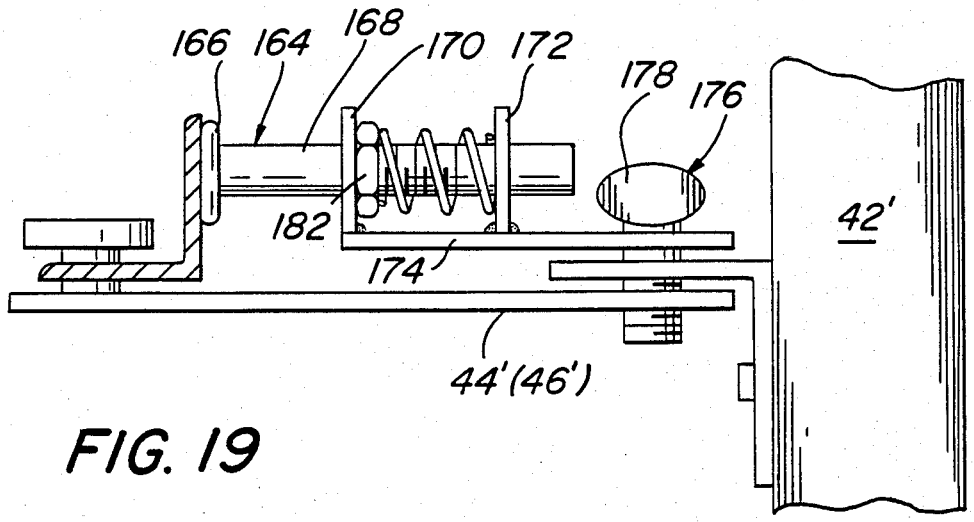
FIG. 19

FIG. 20
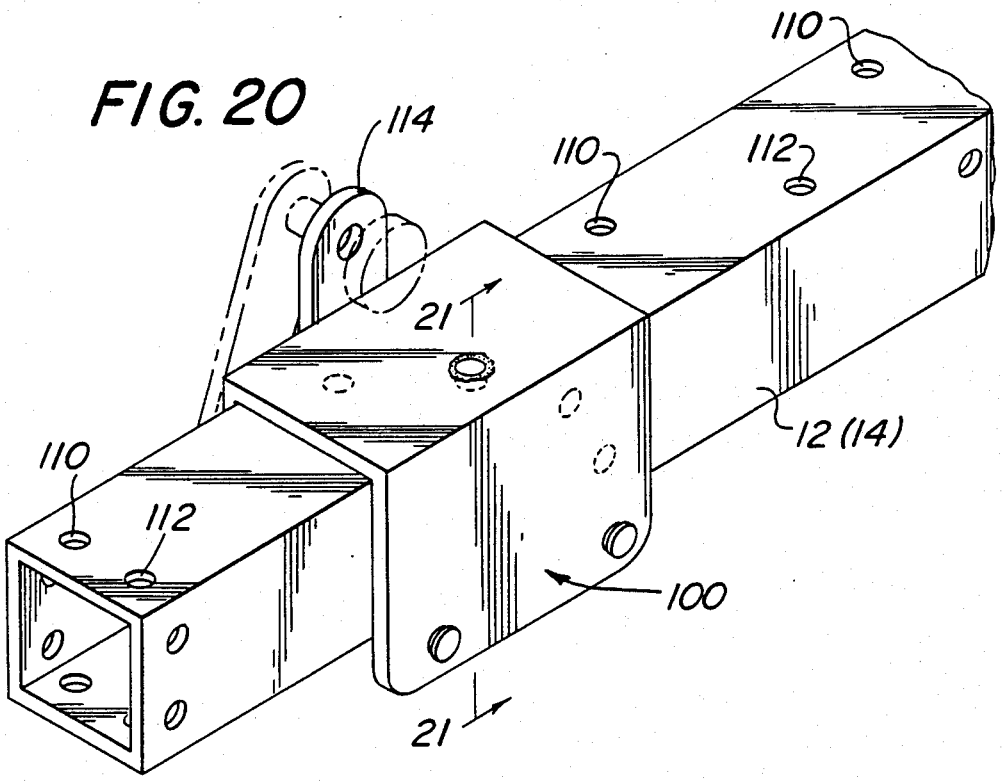
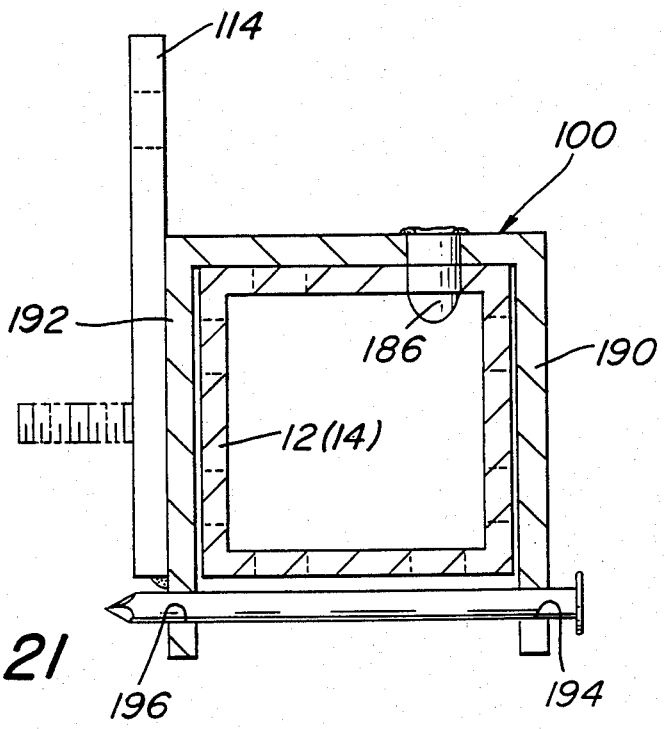
FIG. 21

FIXTURE AND METHOD OF LAYING SHINGLES ON THE SURFACE OF A ROOF OR VERTICAL WALL

This is a continuation-in-part of co-pending application Ser. No. 81,770 file on Aug. 4, 1987, now abandoned.

BACKGROUND OF THE INVENTION

The present invention is directed to a fixture and method of laying shingles on the surface of a roof or vertical wall. The fixture is particularly useful in laying thin pliable shingles, such as asphalt shingles. However, the fixture may be used to lay any type of shingle including thick rigid shingles, such as cedar or tile shingles. One or more fixtures may be simultaneously employed to rapidly shingle a roof or vertical wall according to the invention.

Heretofore, it has been known to utilize a fixture comprising a pair of fixed rails and a movable rail or shingle support member to lay shingles on a roof. A roof having surface irregularities such as concavities or depressions may pose a problem in laying thin pliable shingles when using a fixture of this type. Thus, a thin pliable shingle may slip beneath the movable shingle support member at the location of the irregularity in the roof surface. The fixture of the present invention provides a guide or abutment surface for the bottom edges of thin pliable shingles, allowing the shingles to be aligned in a row or course, while ensuring that the shingles do not slip below the abutment surface where there are irregularities in the roof surface.

Fixtures proposed in the prior art known to applicant generally utilize a variety of mechanisms for advancing the movable shingle support member along the pair of fixed rails. The fixture of the present invention utilizes a relatively simple mechanical structure for advancing the movable shingle support member so that the fixture is believed to be less prone to failure or malfunction.

In laying shingles on a surface having an obstacle such as a chimney or dormer (roof) or window casement (vertical wall), a workman must lay identical overlapping rows or courses of shingles to each side of the obstacle. The fixture of the present invention permits the workman to lay identical overlapping rows of shingles on both sides of such an obstacle with relative ease.

In shingling a roof having a chimney or dormer by a conventional technique, the workman lays rows of shingles to one side of the obstacle, terminating in a top or upper row spaced above the obstacle. The workman marks the roof surface with a horizontal chalk line aligned with the top edge of the top row of shingles and, using the chalk line as a guide, extends the top row of shingles across the roof surface on the unshingled side of the obstacle. The workman must then locate a horizontal chalk line at the bottom region of the roof surface on the unshingled side of the obstacle to align the bottom edge of the bottom or lower row of shingles to be laid. The location of the chalk line must be such that successive rows or courses of shingles can be laid on the unshingled side of the obstacle from the bottom row to the top row with uniform overlap of all adjacent rows. If the chalk line is not located properly, due for example to a miscalculation on the part of the workman, the top row of shingles will not overlap the row immediately beneath it in the same manner as other adjacent rows of shingles. This non-uniformity in overlap is unsightly and readily discernible. The fixture of the present invention allows the workman to lay rows of shingles to one side of the obstacle and then immediately locate an imaginary line for the bottom edge of the bottom row of shingles on the unshingled side of the obstacle without making any calculation so that rows of shingles can be rapidly laid on each side of the obstacle from the bottom row to the top row with complete uniformity of overlap between adjacent rows of shingles.

In laying shingles on the surface of a vertical wall having an obstacle such as a window casement, the fixture of the present invention permits the workman to lay rows of shingles simultaneously on both sides of the window casement, with uniform overlap between adjacent rows of shingles on each side of the window casement.

In general, the fixture of the present invention enables a roof or vertical wall to be rapidly shingled and with less personnel thereby effecting a reduction in time and skilled labor. The fixture may be used on roof or vertical wall surfaces with or without obstacles. The fixture is made of a simplified construction and is lightweight and portable.

Other objects and advantages of the invention are described hereinafter in connection with the preferred embodiments.

BRIEF SUMMARY OF THE INVENTION

A fixture for use in laying shingles on the surface of a roof or vertical wall comprising a pair of rails, means for supporting each of the rails such that the rails are spaced in elevation from the surface to permit work therebelow, and a shingle support member pivotably attached to the rails such that the shingle support member is movable between spaced locations along the rails and, at any location, is swingable from a first position to a second position. In the first position, the shingle support member provides an abutment surface for supporting the bottom edge of a row of shingles to be laid. When used to lay thin pliable shingles, the shingle support member is oriented such that it also provides a support surface for supporting the shingles from below when in the first position. When used to lay thick rigid shingles, the shingle support member is oriented such that it provides an abutment surface for supporting the bottom edge of a row of shingles to be laid without providing a support surface for supporting the shingles from below when in the first position. When swung to the second position, the shingle support member clears the shingles that have been laid.

Where the surface to be shingled is the surface of a vertical wall, spring means are provided for biasing the shingle support member towards the vertical wall surface. A spring attachment device is also provided for retaining the shingles against the vertical wall surface.

For shingling a roof having an obstacle thereon, the rails are provided with indicia spaced therealong, the spacing between indicia corresponding to the desired spacing between the bottom edges of adjacent rows of shingles. The fixture is placed on the roof to one side of the obstacle, and rows of shingles are laid on that side of the obstacle. The top row is then extended along the roof to the other side of the obstacle, and the fixture is placed on that side of the obstacle. The bottom edge of the top row of shingles is then aligned with the rail indicia and the rails are clamped in place. The bottom edge of the bottom row of shingles is then aligned with the rail indicia and the bottom row is laid. Intervening rows of shingles are then laid between the top and bottom rows such that the spacing between the bottom edges of adjacent rows of shingles is uniform from the bottom row to the top row.

In shingling a vertical wall having an obstacle thereon, the shingle support member is provided with a pair of spacer blocks so as to space the shingle support member from the vertical wall surface, the spacer blocks being separated so as to locate on opposite sides of the obstacle. The spacer blocks provide an abutment surface for supporting the bottom edge of a row of shingles to be laid on both sides of the obstacle.

BRIEF DESCRIPTION OF THE DRAWINGS

FIG. 1 is a perspective of the fixture of the present invention in use in laying rows of shingles on the surface of a roof having a relatively steep incline.

FIG. 3 is a view of an arm swingably mounted on a rail for supporting a shingle support member, the swinging motion of the arm being indicated by solid and phantom lines.

FIG. 4 is an enlarged view of a portable post and plate adapted to be secured to a roof to support a rail as shown in FIG. 1.

FIG. 5 is an enlarged view showing a portion of the shingle support member secured to the swingable arm shown in FIG. 3.

FIG. 17 is an elevation of an alternate embodiment of the spring device in conjunction with the shingle support member shown in FIGS. 15 and 16.

FIG. 18 is an elevation of the spring device.

FIG. 19 is an elevation of the spring device and shingle support member taken along lines 19—19 in FIG. 17.

FIG. 20 is a partial isometric of an alternate embodiment of the slider and rail.

FIG. 21 is a section taken along lines 21—21 in FIG. 20.

DETAILED DESCRIPTION OF THE INVENTION

Fixture

Figure 2:
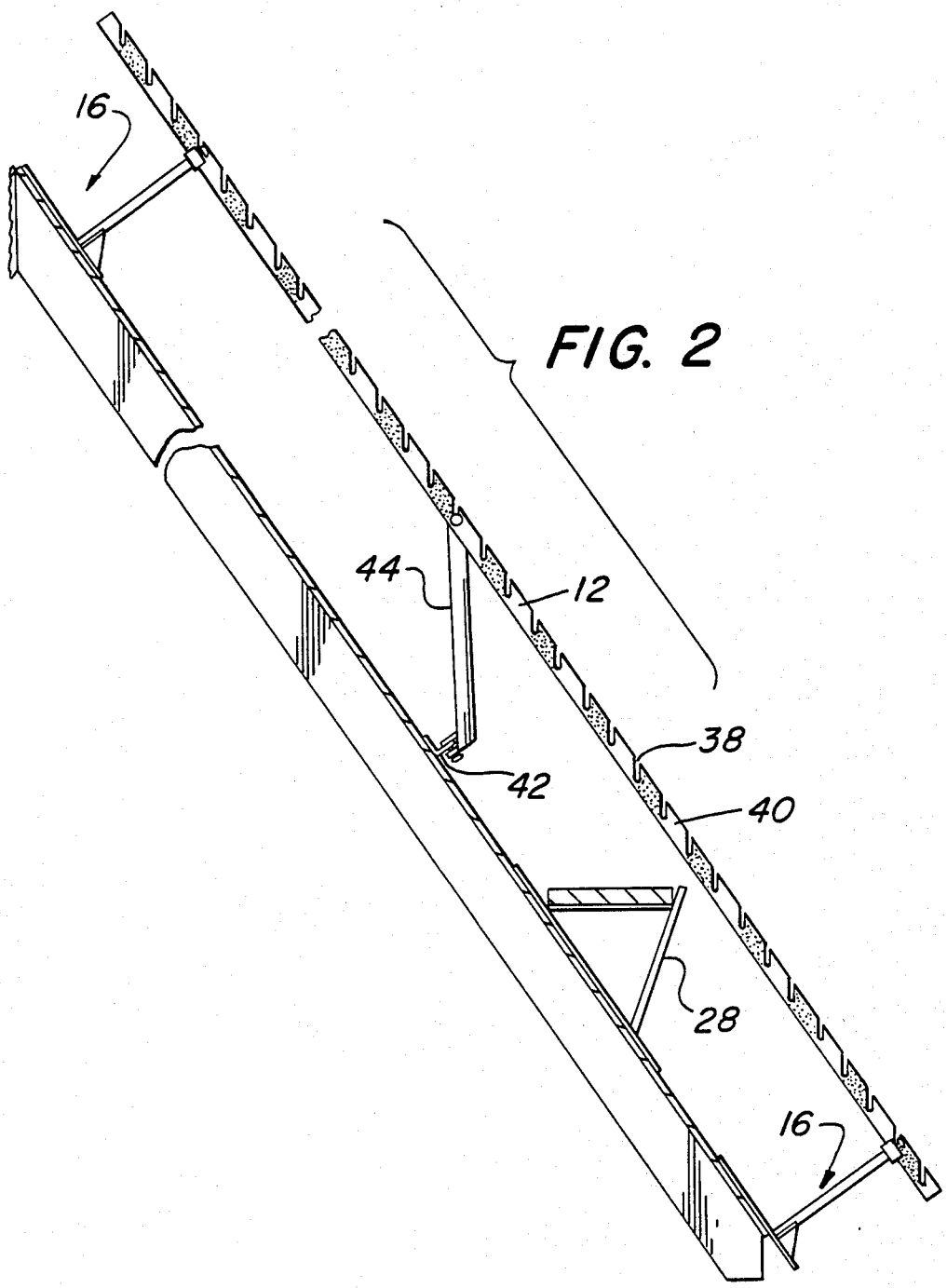
FIG. 2 is a view taken along 2—2 in FIG. 1 showing a rail elevated above a roof jack.

Referring to the drawings, wherein like numerals indicate like elements, there is shown in FIG. 1 a fixture of the present invention designated generally as 10. The fixture includes a pair of spaced parallel rails 12, 14. Each rail is preferably L-shaped in section. Each rail is supported at each of its end portions by a like support assembly 16 comprising a post 18 welded to a plate 20. Each post 18 and plate 20 presents a unified support structure for the rail. Each post is preferably L-shaped in section. A U-shaped clamp 22 is welded to the top of the post and is provided with a threaded opening for receiving an adjustment screw 26. See FIG. 4. One leg of the vertical rail at each end portion of the rail is received within the U-shaped clamp and is secured thereto by means of the adjustment screw. For steep roofs, the workman may use roof jacks 28 in the conventional manner to provide a support surface while laying shingles. The height of each post 18 is chosen such that the rails 12, 14 are spaced in elevation above the roof jacks 28 to permit the workman to use the roof jacks in conventional manner while laying shingles below the rails without obstruction. See FIG. 2.

Each plate 20 is preferably T-shaped having a stem 30 provided with a pair of slots 32, 34 extending from openings along one edge of the plate so as to facilitate securement of the plate to the roof by nails placed at the slots. See FIG. 4. Stabilizing braces or fins 36 are provided to reinforce the support assembly, each fin being welded to the post and plate. Once the shingling operation has been completed, the fixture may be disassembled as further described hereafter. Each support assembly 16 can be removed by using a hammer claw to pry the securement nails up and by then sliding the plate away from the nails. The nails can then be tapped flush to the roof surface.

Each rail 12, 14 is provided with a series of uniformly spaced notches or slots 38 in the rail upstanding leg 40. See FIG. 2. A shingle support member 42 is mounted at each of its opposite end portions on one of a pair of arms 44, 46. The shingle support member is preferably L-shaped in section. Each arm 44, 46 is provided with a projecting lug or pin 48 terminating in a head 50. The pin seats within a vertical slot 38 whereby each arm is pivotably mounted on a rail 12 or 14. Preferably, the rail slots 38 are canted at approximately 15° as shown in FIG. 3 so that the arm lugs 48 drop by gravity into the slots and there is no danger of dislodgement particularly in vertical wall applications as described hereafter.

The free end portion of each arm 44, 46 is provided with a pair of securement plates or tabs 52, 54 which receive an end portion of one leg of the shingle support member. One of the tabs is provided with a threaded opening for receiving an adjustment screw 56. The end portion of the shingle support member leg is clamped between tabs 52, 54 by means of the adjustment screw.

The height of each post 18 and the length of an arm 44, 46 is chosen so that, when the arm is in the position shown by solid lines in FIG. 3, the spacing S between the upstanding leg 58 of the shingle support member and the lug 48, taken along a line parallel to the roof surface, is an integral multiple of the spacing between adjacent rail slots 38. The spacing between adjacent rail slots is equal to the desired spacing between the bottom edges of adjacent rows of shingles to be laid. For example, when laying shingles having a height of twelve inches, the desired spacing between the bottom edges of adjacent rows of shingles may be five inches. The spacing between rail slots 38 is therefore five inches. The height of each post 18 is preferably sixteen inches (to clear the roof jacks), and the length of each arm 44, 46 (between lug 48 and tabs 52, 54) is chosen so that the spacing S is twenty inches, i.e., an even multiple of five inches.

Using the Fixture

In use, a row or course of shingles is laid across the shingle support member and then nailed to the roof. The arms 44, 46 are then swung upwardly to move the shingle support member to the position shown in phantom lines in FIG. 3, and the arms and shingle support member are lifted to remove the lugs 48 from the rail slots 38. The arms are then re-mounted on the rails 12, 14 by locating each arm lug 48 in the next adjacent slot 38 in the associated rail. The arms are then swung downwardly to the position shown in solid lines in FIG. 3 whereby the leg 60 of the shingle support member is flush with the top surface of the row of shingles just laid. The upstanding leg 58 of the shingle support member will now be spaced from the bottom edges of the shingles in the row just laid by a distance equal to the spacing between adjacent slots in the rails. As previously explained, this spacing corresponds to the desired spacing between the bottom edges of adjacent rows of shingles to be laid.

To lay each row or course of shingles, each shingle in the row is positioned so that its bottom edge abuts the upstanding leg 58 of the shingle support member. If the shingles are pliable, such as asphalt shingles, the shingle support member is oriented as shown in solid lines in FIG. 3 so that each shingle is also supported from below by leg 60 of the shingle support member. This prevents the bottom portion of the shingle from dropping below the shingle support member in a depression or like surface irregularity in the roof. After a row or course of shingles has been laid in this manner, with all shingle bottom edges aligned in abutment with shingle support member upstanding leg 58, the shingles are nailed to the roof. One workman may lay and nail the entire row, preferably by laying the row in one direction (left to right) and by then nailing the row in the opposite direction. The arms 44, 46 are then swung by the workman to the phantom line position shown in FIG. 3 to retract the shingle support member from the row of shingles just laid. The shingle support member leg 60 travels along an arc path and lifts and slidably releases the bottom edge portions of the shingles. The shingle support member clears the shingles after relatively little movement along the arc path. The shingle support member may then be advanced along the rails 12, 14 to lay the next row of shingles by de-mounting and re-mounting the arms on the rails as previously described.

Alternate Embodiment of Support Assembly

Figure 6:
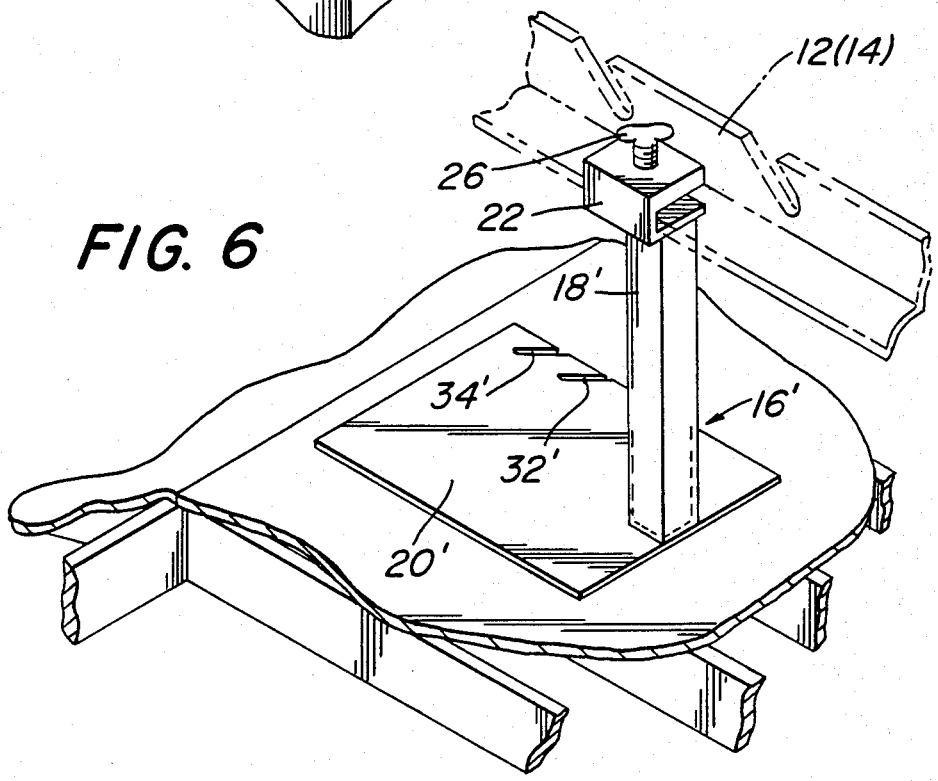
FIG. 6 is an enlarged view of an alternate embodiment of the portable post and plate for use with roofs having a relatively gentle incline.

If the roof is not steep, so that roof jacks are not necessary, an alternate embodiment 16' of the support assembly may be employed as shown in FIG. 6. Support assembly 16' comprises a shortened post 18', also L-shaped in section, and a rectangular shaped plate 20'. The shortened post 18' may have a height of 8 ¾ inches so that the stabilizing braces may be dispense with. Plate 20' is provided with slots 32', 34'. Use and operation of the support assembly 16' is the same as that already described in connection with support assembly 16. When using the modified support assembly 16', the length of each arm 44, 46 would be shortened to obtain a spacing S' (between the arm tabs 52, 54 and lug 48) which is an integral multiple of the spacing between rail slots 38. Preferably, the length of each arm 44, 46 (between tabs 52, 54 and lug 48) is chosen to obtain a spacing S' of ten inches, i.e., an even multiple of the spacing between rail slots 38.

Figure 7:
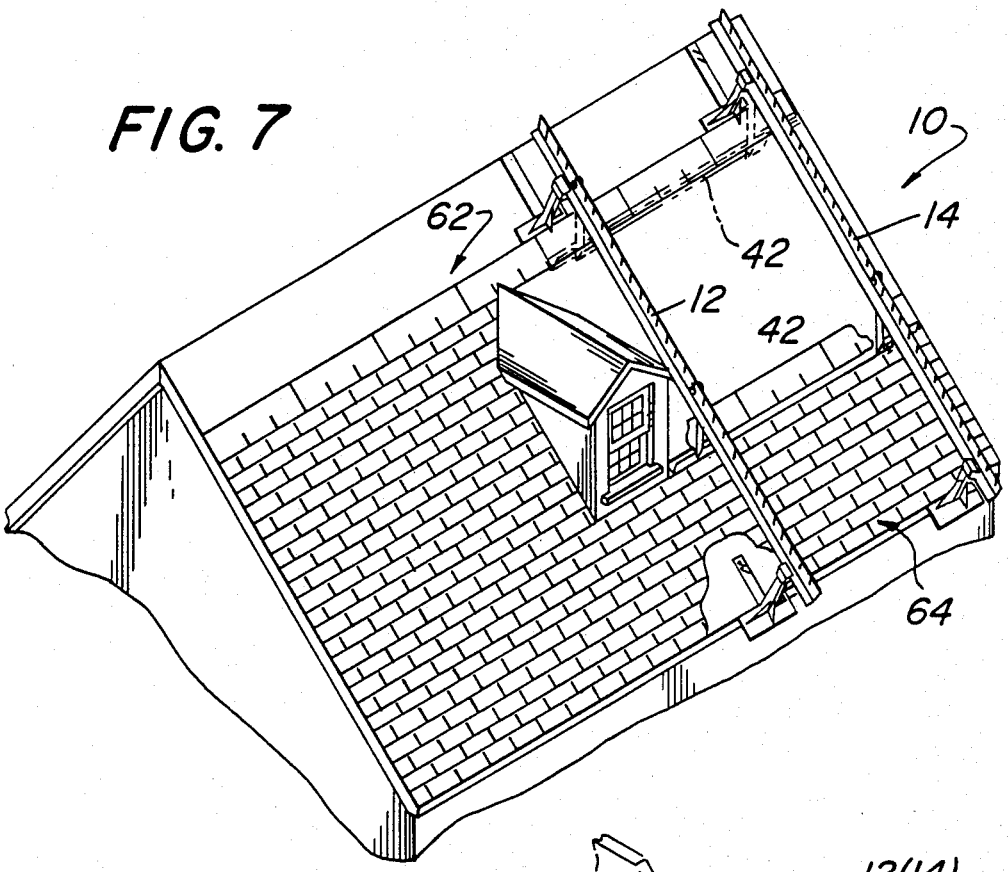
FIG. 7 is a perspective of the fixture of the present invention in use in laying rows of shingles around an obstacle such as a dormer on a roof.

Shingling Around a Roof Obstacle

Where the roof is provided with an obstacle such as a chimney or dormer, as shown in FIG. 7, the fixture 10 is used to lay and nail successive rows or courses of shingles on the roof to one side of the obstacle in the manner previously described, terminating in a top row of shingles 62 which is spaced along the roof above the obstacle. The workman may then strike a chalk line coincident with the top edge of the top row of shingles and extending to the unshingled side of the roof on the opposite side of the obstacle. The top row of shingles may then be extended along the roof, utilizing the chalk line as a guide for the top edges of the shingles. The fixture 10 is then placed on the unshingled side of the roof to lay successive rows or courses of shingles from the bottom region of the roof to the extended top row 62, without making any calculation and without locating a chalk line for the bottom edge of the bottom row of shingles to be laid.

For this application, each vertical rail 12, 14 is provided with indicia uniformly spaced therealong. The indicia may take the form of scribe marks, each of which is located at a rail slot 38. Preferably, however, the rails 12, 14 are color coded as shown in FIG. 2 so as to provide indicia at the rail slots which are readily visible from a distance. More specifically, each rail 12, 14 is marked in an alternating pattern of colored segments by painting or otherwise marking the exterior surface of the rail. For example, the exterior rail surface may be alternately marked in red and white paint, the dividing line between adjacent painted segments being coincident with a rail slot 38. The dividing line is therefore readily discernable by the workman.

To apply rows of shingles on the unshingled portion of the roof, to one side of the obstacle, with perfect uniformity in spacing between the bottom edges of adjacent rows, the workman mounts the arms 44, 46 and shingle support member 42 on the rails 12, 14 as shown in phantom in FIG. 7 and then positions the vertical rails so that the bottom edge of the extended top row 62 aligns with shingle support member leg 58. The workman then clamps the rails 12, 14 in position on the support assemblies 16 (or 16'). Since the spacing S (or S') is an integral multiple of the spacing between adjacent rail slots, shingle support member leg 58 will align (along a normal to the roof) with a dividing line between adjacent red and white segments along each rail 12, 14. Because the distance between adjacent rail slots corresponds to the desired spacing between bottom edges of adjacent rows of shingles, the workman does not need to make any calculation to properly locate an imaginary line for the bottom edge of the bottom row of shingles to be laid. Instead, the workman need only de-mount the arms and shingle support member and re-mount them on the rails 12, 14 such that the shingle support member now aligns with a dividing line (between red and white segments) which is proximal the bottom edge of the roof. The bottom row 64 of shingles may then be laid and nailed to the roof, using the fixture as previously described. Successive rows may then be laid between bottom row 64 and extended top row 62 by advancing the shingle support member along rails 12, 14 as already described. All rows of shingles will overlap uniformly, from the bottom row to the top row.

Reversing the Shingle Support member

In the preceding description of the fixture 10, the shingle support member 42 is L-shaped in section and oriented as shown in solid lines in FIG. 3 so as to facilitate placement of rows of thin pliable shingles, such as asphalt shingles, on the roof. Although the invention is particularly suited for use in laying thin pliable shingles, it is not so limited. The fixture 10 may also be used to lay shingles such as cedar and tile which are relatively thick and rigid. These shingles do not tend to slip below the shingle support member at an irregularity of the roof surface and therefore require no support from below in order to be laid. To lay these shingles, the orientation of the shingle support member is reversed so that the shingle support member leg 60 extends downwardly as shown in phantom in FIG. 5. The backside of the upstanding leg 58 is then used as the abutment surface for aligning the bottom edges of the shingles without supporting the shingles from below. When the shingle member is swung upwardly, it travels along an arc path so as to clear the shingles just laid without lifting the shingles. If the orientation of the shingle support member were nor reversed, the member could be wedged in position between overlapping rows of shingles due to the relative thickness and rigidity of the shingles. If the workman attempted to swing the shingle support member upwardly, to dislodge it, the member would tend to lift the shingles thereby breaking the shingles or prying loose the nails which secure the shingles to the roof.

Shingling a Vertical wall

Figure 8:
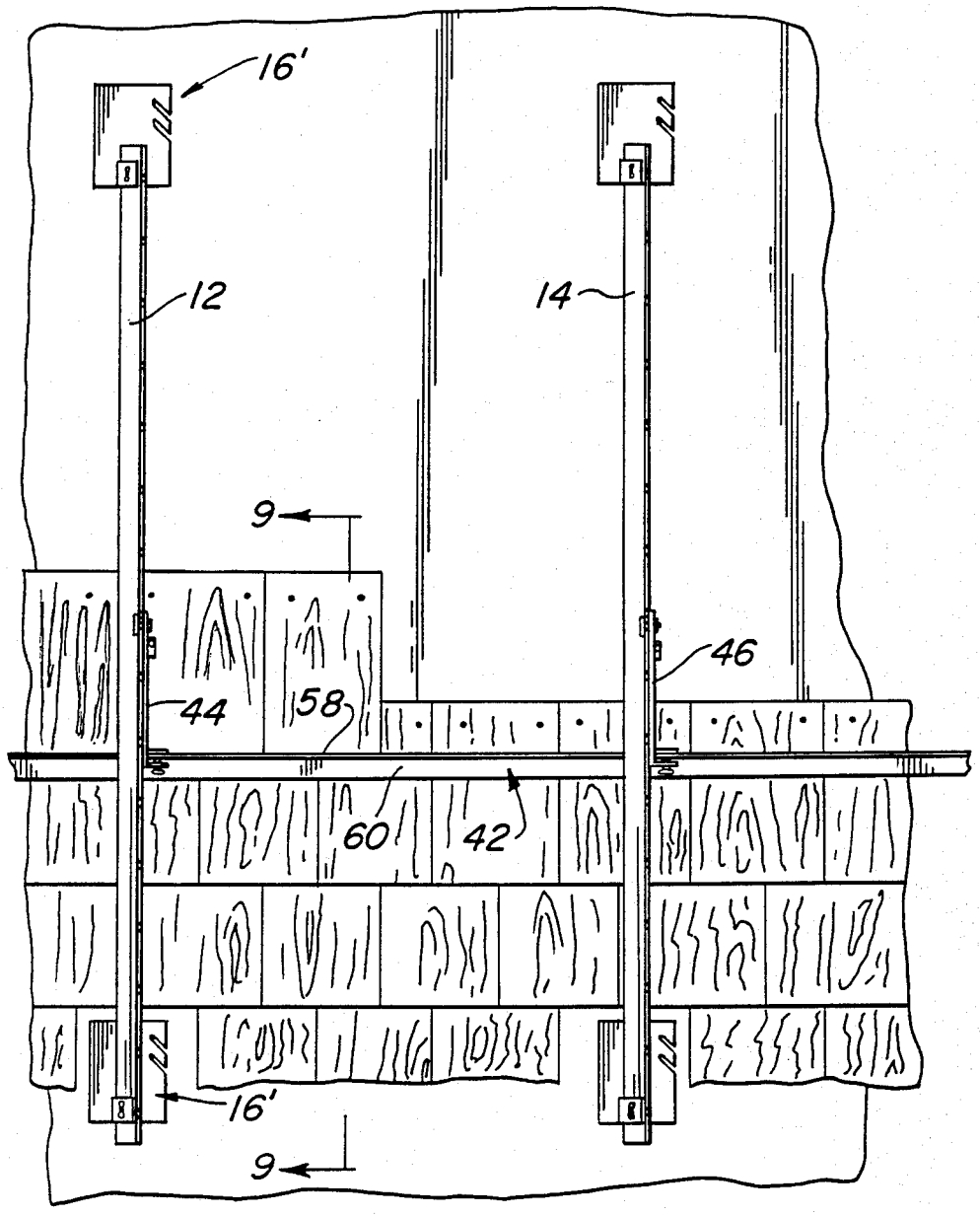
FIG. 8 is a view of the fixture of the present invention in use in laying rows of shingles on the surface of a vertical wall with a spring device resiliently biasing the swingable arm towards the wall surface.
Figure 9:
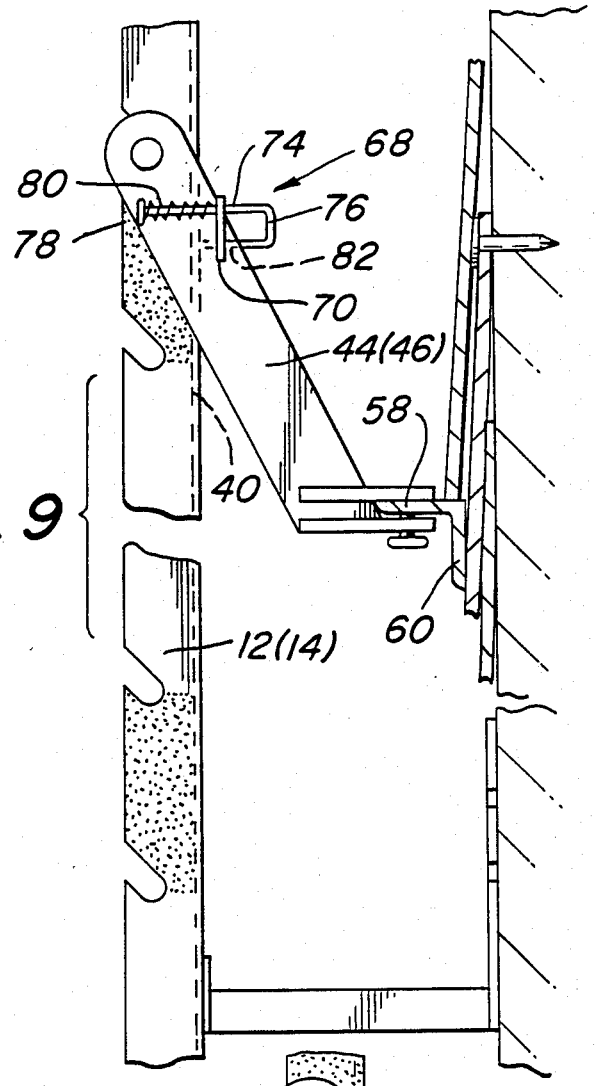
FIG. 9 is a view taken along 9—9 in FIG. 8.
Figure 12:
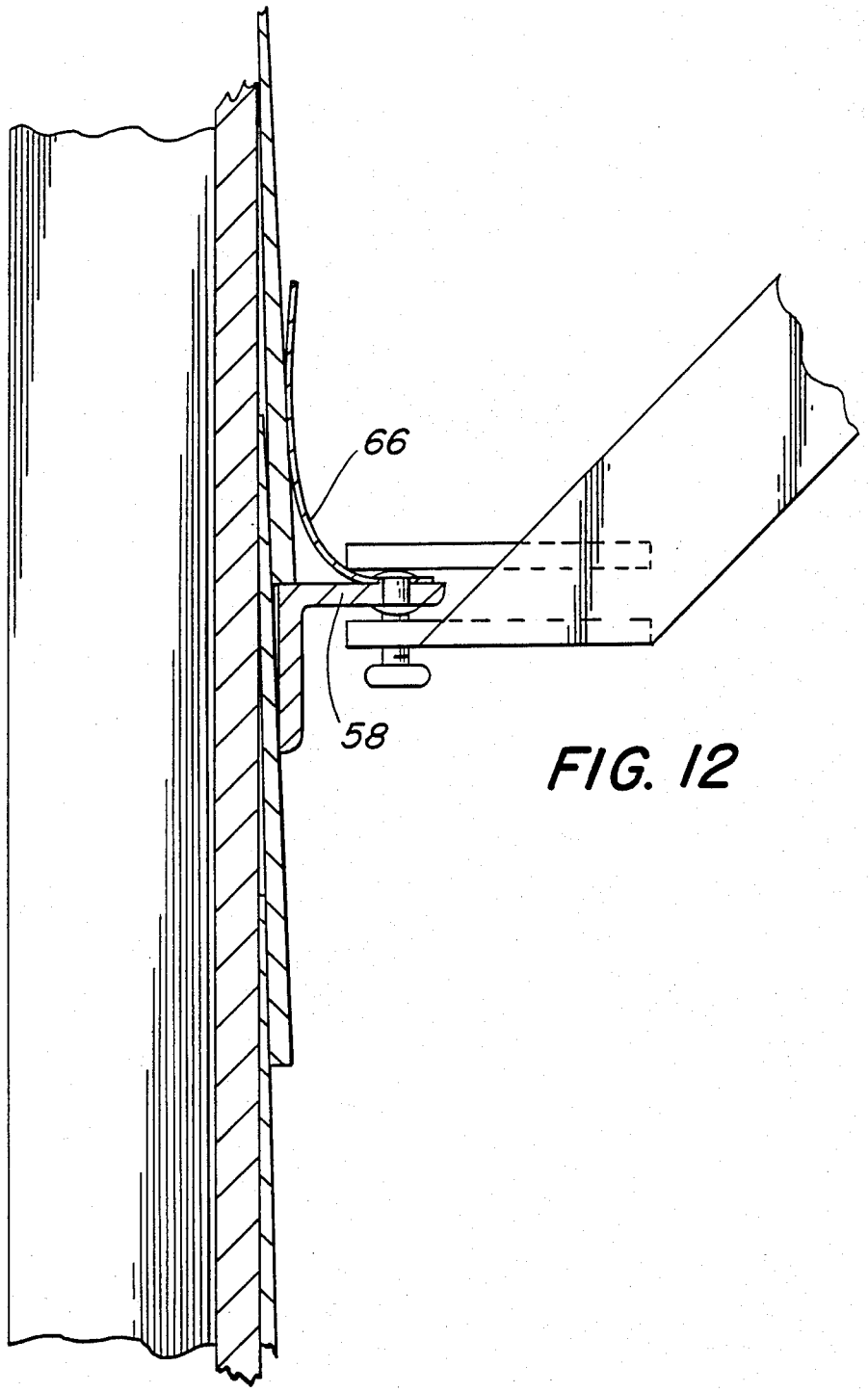
FIG. 12 is a view of a spring attachment for the shingle support member for use in retaining shingles against a vertical wall.

The fixture 10 may also be used in laying shingles on the surface of a vertical wall as shown in FIGS. 8 and 9. In laying rows of shingles on a vertical wall surface, the shingle support member 42 is oriented such that leg 60 points downwardly (as previously described) whereby the backside of leg 58 provides the abutment surface for aligning the bottom edges of the shingles. To secure the shingles in position against the vertical wall surface, a spring attachment device such as an elongated leaf spring 66 is attached by pop rivets or the like along leg 58. See FIG. 12. Preferably, the spring 66 is bowed so as to bear against each of the shingles in the row, holding each of the shingles against the vertical wall. Each of the shingles may then be nailed to the vertical wall surface.

As shown in FIG. 9, a spring device 68 may be utilized to bias each arm 44, 46 against the vertical wall. Each spring device 68 includes a spring support plate or tab 70 welded to arm 44 or 46. Each spring support plate is provided with a through bore, and the shank 74 of a J-shaped member 76 extends through the bore. Each J-shaped member is provided with an enlarged or rounded head 78, and a helical spring 80 is mounted between the head 78 and plate 70. When the fixture 10 is to be used in laying shingles on a vertical wall surface, each J-shaped member is rotated so that the upturned leg portion 82 thereof bears against the associated rail leg 40. Since each rail 12, 14 is clamped to a support assembly 16 (or 16') which is in turn secured by nails to the vertical wall, spring pressure is exerted against spring support plate 70 so as to bias arm 44 (or 46) towards the vertical wall and thereby prevent the arm from swinging away from the wall.

Figure 11:
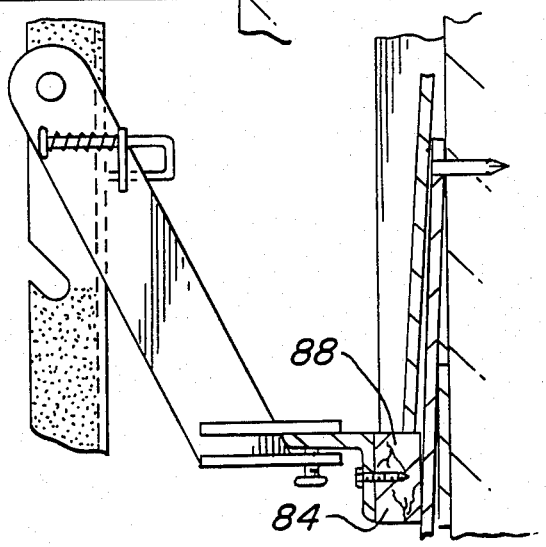
FIG. 11 is a view taken along 11—11 in FIG. 10.
Figure 10:
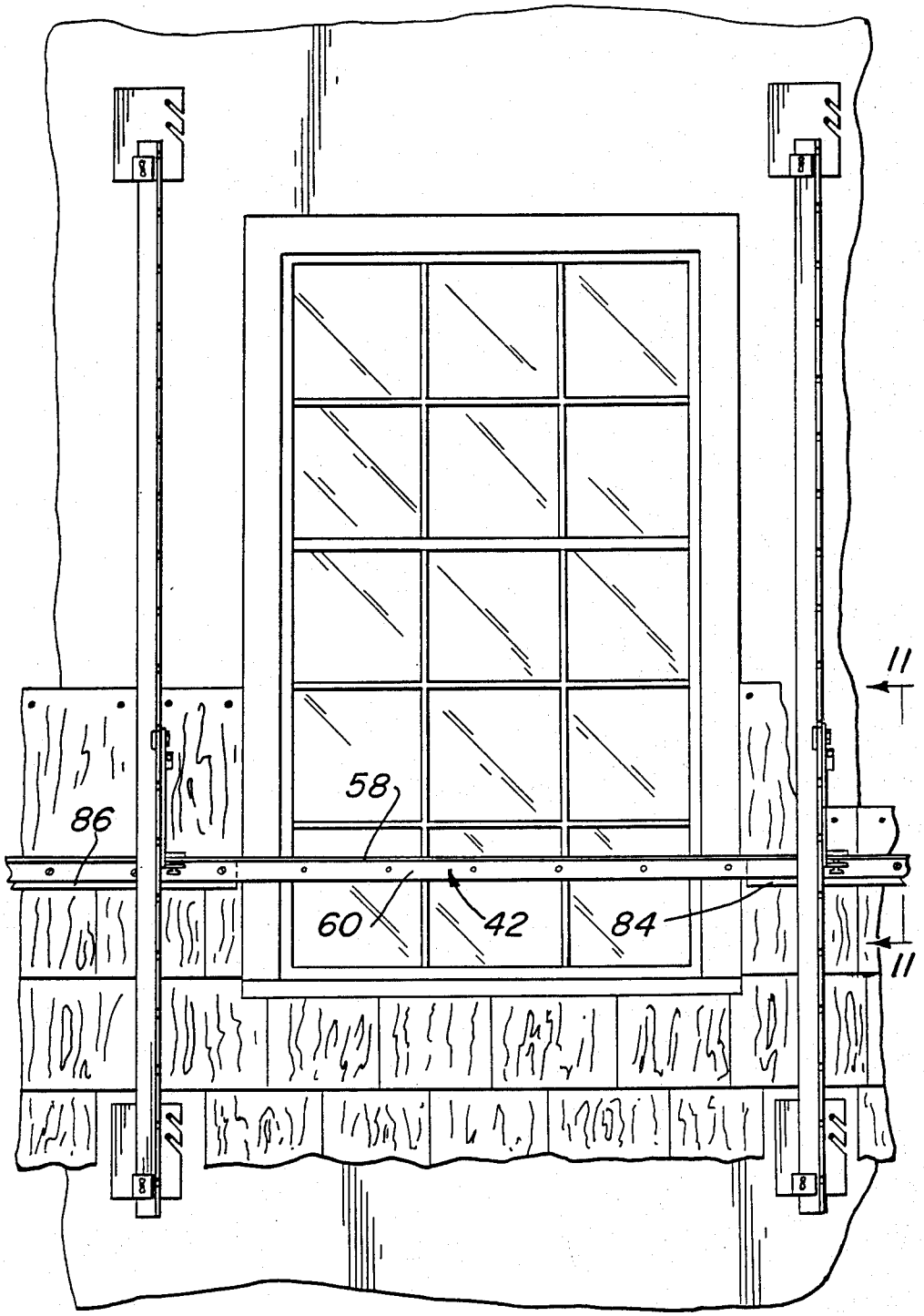
FIG. 10 is a view of the fixture of the present invention in use in laying rows of shingles around an obstacle such as a window casement on a vertical wall, spacer blocks being secured to the shingle support member.

Shingling Around a Wall Obstacle

Where a vertical wall surface is obstructed by an obstacle such as a window casement, the modification of the fixture 10 shown in FIGS. 10 and 11 may be used. For this application, a pair of spacer blocks 84, 86 are mounted on the support member leg 58 by screw fasteners of the like. The spacer blocks may therefore be readily demounted to us the shingle support member in other applications as already described. The spacer blocks are spaced apart, along the shingle support member, by a distance slightly in excess of the horizontal dimension of the obstacle so as to provide lateral clearance between the spacer blocks and each side of the obstacle. The thickness of each spacer block is chosen so as to permit shingle support member 42 to clear the obstacle with the spacer blocks flush against shingles laid on the wall surface on each side of the obstacle. The upper surface 88 of each spacer block provides an abutment or support surface for the bottom edge of a row of shingles to be laid on each side of the obstacle. With the shingle support member swung to the position shown in FIG. 10, a row or course of shingles can be laid on the spacer blocks on both sides of the obstacle. After shingling the vertical wall surface on both sides of the obstacle, the spacer blocks 84, 86 can be removed and the fixture 10 used as previously described to shingle the remaining portion of the vertical wall surface above the obstacle.

Disassembly

To disassemble the fixture 10, the adjustment screws 56 are retracted, and the shingle support member is removed from arms 44, 46. The arms are then lifted and removed from rails 12, 14. The adjustment screws 26 are then retracted, and the rails 12, 14 are then removed from the clamps 22. Each support assembly 16 (or 16') is then removed from the roof (or vertical wall) by using a hammer claw to pry the securement nails and by then sliding the plate away from the nails. The nails are then tapped flush to the roof (or vertical wall) surface. All parts are preferably made of a lightweight but sturdy metal so that they can be conveniently hauled away.

Figure 13:
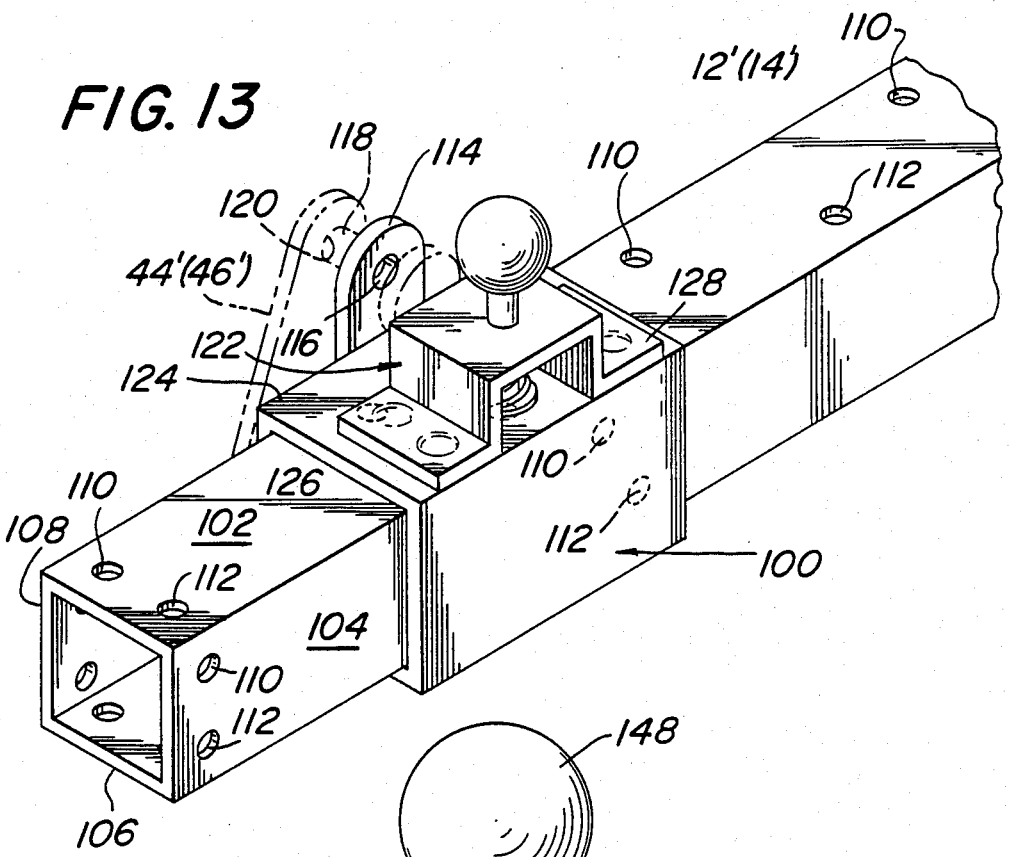
FIG. 13 is a partial isometric of slider and alternate rail embodiment according to the invention.

Referring to FIG. 13, there is shown a slider 100 mounted on a rail 12' (14'). In practicing the invention, there would one such slider on each rail 12' (14'). Preferably, each rail is a tube having a square-shaped section, although the rail may also have a C-shaped or other cross-section. Each of the four faces or sides of the rail 102, 104, 106, 108, is provided with a pair of rows 110, 112 of spaced openings. The spacing between the openings in row 110 is different from the spacing between the openings in row 112. For example, on face 102, the spacing between openings in row 110 may be five inches. Similarly, on face 104, the spacing between the openings in row 110 may be six inches while the spacing between the openings in row 112 may be six and one-half inches. The spacings between opening in the row on the third rail face may be seven inches and seven and one half inches respectively. Other spacing dimensions may, of course, be utilized. The spacing between openings in a row will correspond to the spacing between the bottom edges of adjacent rows of shingles to be laid on a roof.

The slider 100 is tube segment having a square-shaped cross-section. The slider includes an ear 114 provided with an opening 116. The non-threaded portion of the shank of a pin 118 extends through the opening. The pin is preferably threaded along a portion of its shank which is secured in a threaded opening 120 in a swing arm 44′ (46′). Thus, the pin pivotably couples the swing arm to the slider, the swing arm being coupled to the pin so as to move with the pin about its longitudinal axis.

A bracket 122 is mounted on the slider face 124, for example by spot welding the bracket flanges 126, 128 to the slider face. The bracket is provided with an opening 130, and the slider face is provided with an opening 132. Openings 130, 132 are aligned such that the shank of a pin 134 extends through the openings and an opening in one of the rows of rail openings 110 (112). As shown in FIG. 13, the bracket 122 is offset from the slider center line so that the slider can be de-mounted from the rail, rotated 180° (about an axis normal to the rail longitudinal axis) and re-mounted on the rail so as to align the pin with the openings in the adjacent row 112 (110) on the same rail face. This allows the desired spacing between the bottom edges of adjacent rows of shingles to be changed. In addition, the slider may be de-mounted from the rail, rotated 90°, 180° or 270° (about its longitudinal axis), and re-mounted on the rail so as to align the pin with other rows of rail openings on other rail faces. Thus, the slider may be mounted on the rail so as to align pin 134 with any of the rows of openings 110, 112 on any of the rail faces 102, 104, 106 or 108. At least eight different spacings may therein be selected for adjacent shingle rows.

Figure 14:
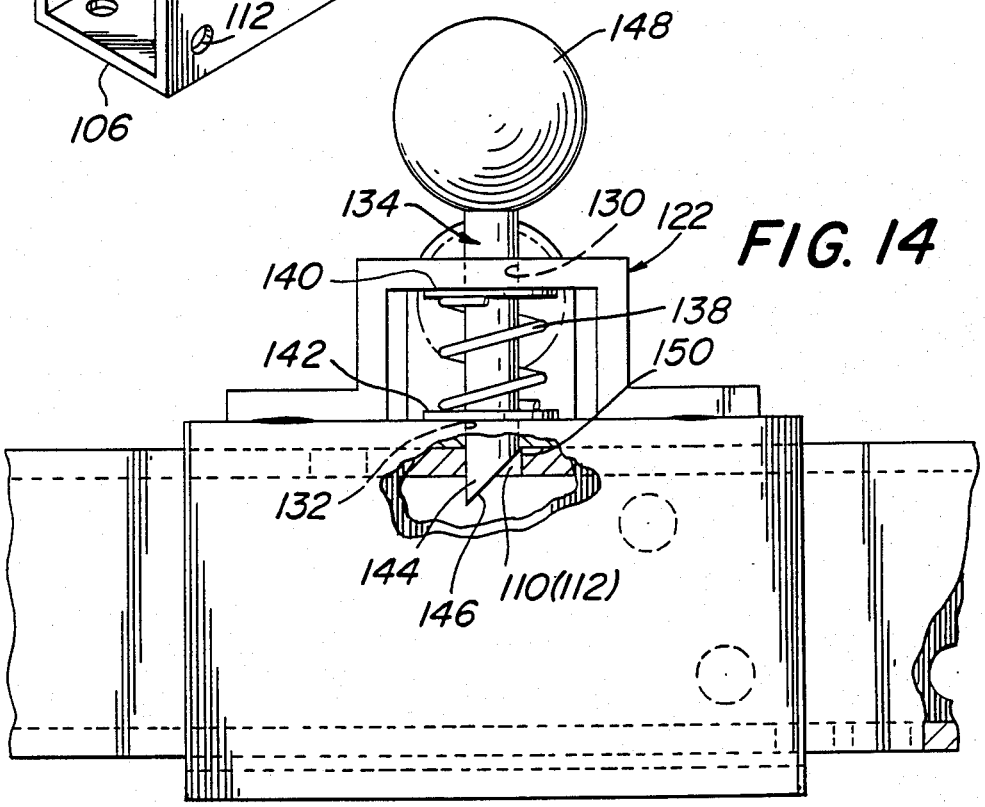
FIG. 14 is a side elevation of the slider in FIG. 13.

As shown in FIG. 14, the pin 134 is spring biased downwardly into engagement with a rail opening 110 (112). A helical spring 138 is captured between a washer 140 and an annular flange 142 on the shank of the pin. Thus, the pin is spring-urged downwardly so that the end portion of the shank enters opening 110 (112) whereby the slider is locked in position on the rail.

Figure 15:
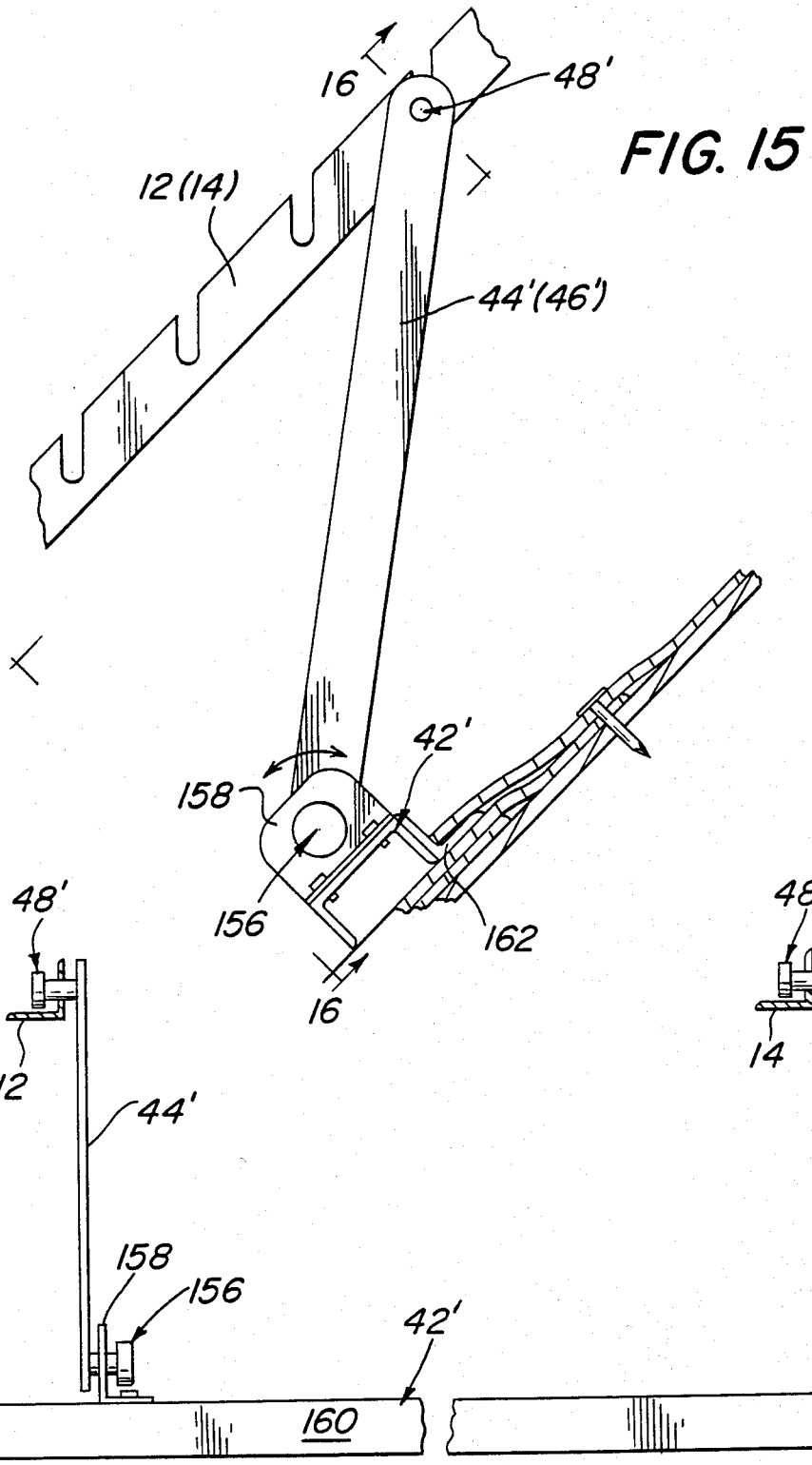
FIG. 15 is an elevation of an alternate embodiment of the swing arm and shingle support member according to the invention
Figure 16:
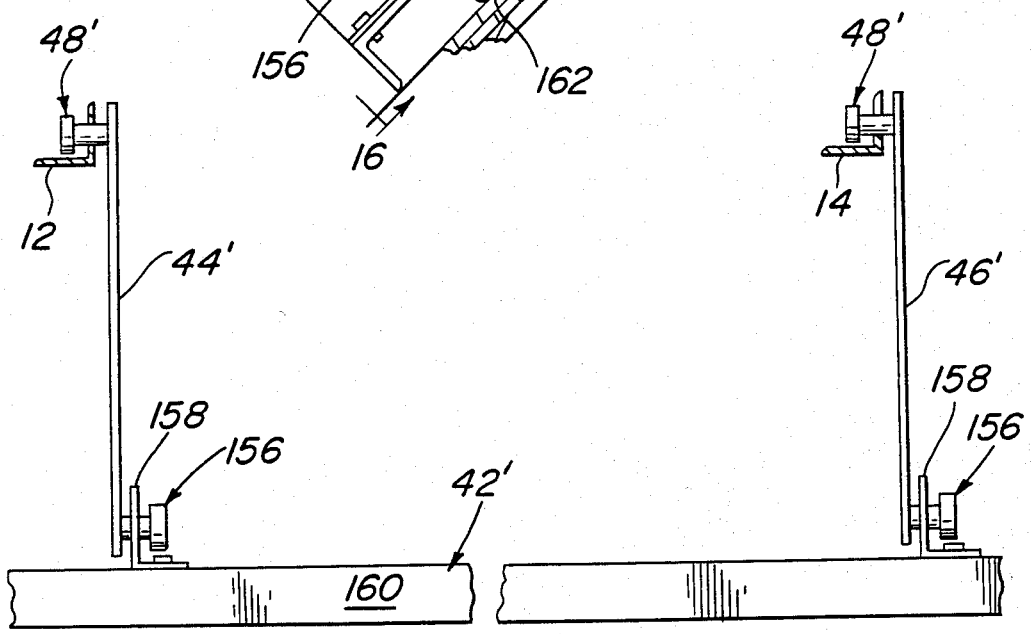
FIG. 16 is an elevation showing the swing arms and shingle support member suspended from the rails.

The end portion 144 of the pin shank is beveled at 146 so as to provide a cam surface for lifting the pin when the slider is advanced in one direction along the rail, i.e., the direction along which adjacent rows of shingles are being laid in succession. The pin is also provided with a head 148 which can be conveniently grasped so as to lift the pin slightly against spring pressure such that the shank bevel 146 contacts the top edge 150 of opening 110 (112) whereby the 42′ is pivotably mounted on the lower end portion of each swing arm 44′, or 46′. See FIG. 16. Thus, the support member 42′ may be "kicked" or swung away from a row of shingles, once laid, with relative ease. Thereafter, the swing arms 44′, 46′ may be lifted from the rails 12′, 14′ and re-mounted thereon in preparation for the next row of shingles. By allowing the shingle support member 42′ to pivot about the pin 156 (on each swing arm) the L-shaped member 162 will rest flush on the roof (as shown in FIG. 15) despite any difference between the heights of the posts 18 which support a rail 12 (or 14).

Alternative Embodiment Of Spring Device

Referring to FIGS. 17 and 18, there is shown an alternate embodiment of the spring device 68′ for use with the modified swing arm 44′ (46′) and modified shingle support member 42′. The spring device 68′ comprises a push rod 164 having a head 166 and a shank 168 which extends through a pair of spaced ears or bushings 170, 172 which are part of an arm 174. The arm is pivotably mounted on the unthreaded portion of the shank of a pin 176. The pin has a head 178 and a threaded shank portion which is received in a threaded opening in swing arm 44′ (46′).

As shown in FIG. 19, the shank of pin 176 extends through the non-threaded opening in bracket 158 whereby the shingle support member 42′ is pivotably mounted on the pin.

The push rod shank 168 is threaded as shown in FIGS. 18 and 19. A nut 182 is threaded on the push rod shank. A helical spring 184 is captured between the nut and the ear 172 thereby urging the push rod 164 such that the nut is flush against the ear 170.

In use, the shingle support member 42′ is swung on the pin 176 such that the C-shaped channel member 160 is urged against the vertical wall as shown in FIG. 17. The nut 182 is moved along the threads of the push rod shank, either compressing the spring or allowing it to release (depending on the direction of movement of the nut), until the desired length of push rod shank above ear 170 (FIG. 19) is obtained such that the push rod head butts up against the rail 12 (14) (FIG. 17). (If a rail having a square or C-shaped section is utilized, the push rod head butts up against a rail face or rail edges.) The nut is then turned slightly so as to compress the spring and exert the force necessary to lock the shingle support member in position against the wall by a wedging action.

Alternate Embodiment Of Slider

Figure 22:
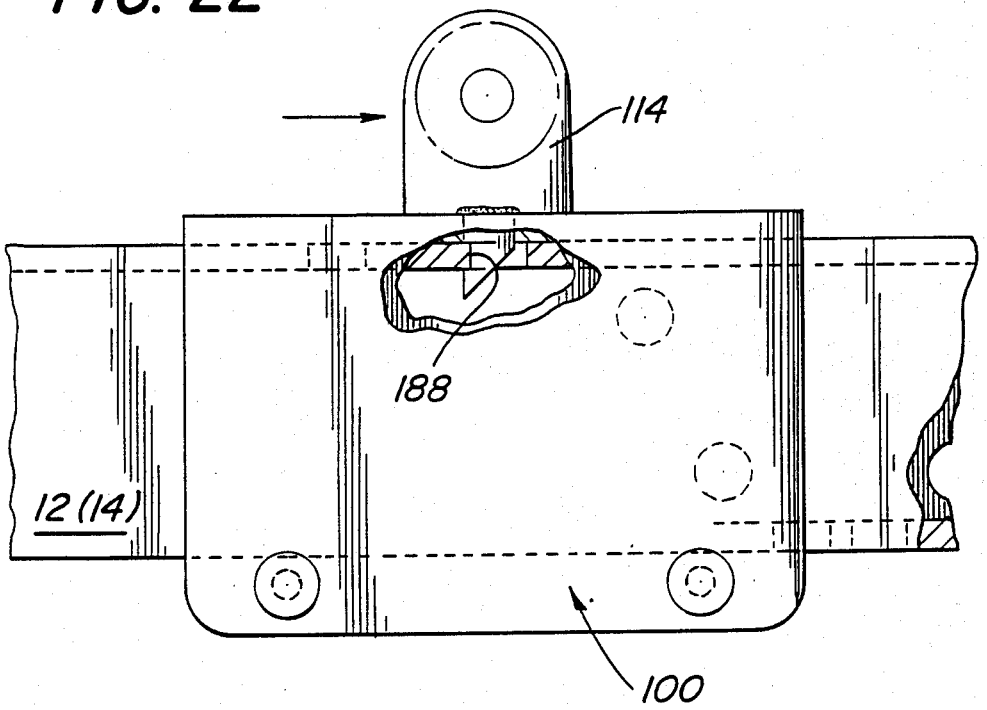
FIG. 22 is an elevation of the slider in FIG. 20.

Referring to FIGS. 20–22, there is shown an alternate embodiment of the slider 100′. In this embodiment, the bottom face of the slider has been omitted whereby the slider has a C-shaped section (FIG. 21). A cam finger 186 is secured (preferably welded) to the slider as shown in FIG. 21. The finger 186 is offset from the center line of the slider so as to align with one of the rows of rail openings 110, 112 on a rail face. The slider is provided with an ear 114 for receiving the pin of a swing arm as previously described. Alternatively, the slider may be provided with a stud as shown in phantom in FIG. 21. The upper end portion of the associated swing arm would then have a through hole whereby the swing arm may be pivotably mounted on the stud. The slider is advanced along the rail 12 (14) in the right hand arrow direction (FIG. 22) whereby the ramp of the cam finger rides over the top edge of a rail opening thereby lifting the slider out of engagement with the rail. The cam finger rides over the rail face, as the slider is advanced along the rail, until the finger encounters the next rail opening 110 (112). The finger then drops in the rail opening thereby locking the slider in position along the rail once again.

Preferably, the cam finger is also provided with a notch 188 (FIG. 22) whereby the notch is engaged by an edge portion of a rail opening to lock the finger in position, particularly when the rail 12 (14) is oriented vertically when shingling a wall. Similarly, to prevent the slider from dislodging from a vertically oriented rail, the slider faces 190, 192 are provided with aligned openings 194, 196 through which a nail, pin or like member extends.

It should be appreciated that the cam finger 186, like the spring urged pin 134, allow only unidirectional motion of the slider 100 or 100′ along the rail 12 (14). Motion of the slider 100, in the reverse direction (left hand arrow FIG. 22) along the rail is prevented by the cam finger 186 unless the slider is lifted by the user so as to withdraw the cam finger from the associated rail opening. Motion of the slider 100 in the reverse direction along the rail is prevented by pin 134 unless the pin is grasped and lifted against spring pressure so as to withdraw the pin from the associated rail opening.

The present invention may be embodied in other specific forms without departing from the spirit or essential attributes thereof and, accordingly, reference should be made to the appended claims, rather than to the foregoing specification, as indicating the scope of the invention.

I claim:

1. Fixture for use in laying shingles on the surface of a roof or vertical wall, comprising a pair of rails, each provided with discrete openings at predetermined spaced locations therealong, means for supporting each of said rails such that said rails are spaced from said surface, a shingle support member, and means for pivotably attaching said shingle support member to said rails at said predetermined spaced locations therealong such that said shingle support member is swingable at each location from a first position to a second position, the shingle support member providing an abutment surface for supporting the bottom edge of a row shingles to laid when in said first position and the shingle support member clearing the shingles when in said second position, such that the shingle support member is displaceable along the surface in predetermined increments corresponding to the spacing between said predetermined rail locations.

2. Fixture according to claim 1 wherein said shingle support member provides another surface for supporting said shingles from below whereby said shingles are supported along their bottom edges and from below when said shingle support member is in said first position.

3. Fixture for use in laying shingles on the surface of a roof or vertical wall, comprising:

a pair of rails, means for supporting each of said rails such that said rails are spaced from said surface, a shingle support member, means for pivotably attaching said shingle support member to said rails at a plurality of spaced locations therealong such that at leach location said shingle support member is swingable from a first position to a second position, the shingle support member providing an abutment surface for supporting the bottom edge of a row of shingles to be laid when in said first position and the shingle support member clearing the shingles when in said second position, and spring means for biasing said shingle support member towards said surface at said roof or vertical wall.

4. Fixture according to any one of claims 1, 2 and 3 wherein at least one of said rails is provided with indicia spaced therealong, the spacing between indicia corresponding to the desired spacing between the bottom edges of adjacent rows of shingles to be laid.

5. Fixture according to any one of claims 1, 2 and 3 wherein each of said rails is provided with spaced slots therealong, and wherein said means for pivotably attaching said shingle support member to said rails includes a pair of swingable arms, each swingable arm having a pivot pin adapted to fit within a slot of a rail such that the arm is pivotably supported on the rail, each arm having means for securing said shingle support member thereto, whereby said swingable arms and shingle support member are swingable in unison between said first and second positions.

6. Fixture according to claim 5 wherein the spacing between said slots corresponds to the desired spacing between the bottom edges of adjacent rows of shingles to be laid.

7. Fixture according to claim 6 wherein the separation along said surface of said roof or vertical wall between each swingable arm pivot pin and the shingle support member is an integral multiple of the spacing between said slots when said shingle support member is in said first position.

8. Fixture according to any one of claims 1, 2 and 3 wherein said means for supporting each of said rails includes a pair of portable support assemblies for each rail, each support assembly comprising a plate adapted to be secured to said surface of said roof or vertical wall, an upstanding post secured to said plate, and means for securing a rail to the post by clamping a portion of the rail.

9. Fixture according to claim 3 including means attached to said shingle support member for retaining said shingles against a vertical wall surface.

10. Fixture according to claim 1 or claim 3 including a pair of spacer blocks secured to said shingle support member so as to space said shingle support member from said surface of said vertical wall, said spacer blocks being separated by a distance corresponding to a dimension of an obstacle on said surface, and said spacer blocks providing a supporting abutment surface for the bottom edge of a row of shingles to be laid on opposite sides of the obstacle.

11. Method of laying shingles on the surface of a roof or vertical wall having an obstacle such as a chimney or a dormer, comprising:

laying a top row of shingles on the surface above the obstacle.

positioning a pair of rails, each having discrete openings at predetermined spaced locations therealong corresponding to a desired spacing between bottom edges of adjacent rows of shingles to be laid, on an unshingled portion of the surface to one side of the obstacle such that the rails are spaced from the surface.

swingably mounting a shingle support member at a first one of said predetermined locations along each of said rails, moving said rails such that said shingle support member aligns with the bottom edge of said top row of shingles and then fixing said rails in position, de-mounting said shingle support member from each of said rails and swingably re-mounting said shingle support member at a second one of said predetermined locations along each of said rails, laying a bottom row of shingles on said unshingled portion of said surface such that the bottom edge of said bottom row of shingles abuts said shingle support member at said second location, said first and second predetermined locations of said shingle support member along said rails being spaced apart by the desired spacing between bottom edges of said top and bottom rows of shingles, sequentially advancing said shingle support member between successive predetermined spaced locations along said rails and laying a row of shingles at each location of said shingle support member such that the bottom edge of the row of shingles abuts said shingle support member, whereby the spacing between the bottom edges of adjacent rows of shingles laid on said surface to said one side of said obstacle is uniform between said top and bottom rows.

12. Method according to claim 11 wherein at least one of said rails is provided with indicia space therealong, the spacing between indicia corresponding to the spacing between said predetermined locations along said rail, and using said indicia to mount said shingle support member at said second predetermined location on said rails.

13. Method of laying thin pliable shingles on the surface of a roof or vertical wall, comprising:

positioning a pair of rails each having spaced slots therealong such that the rails are spaced from said surface, swingably mounting a shingle support member at a slot on each of said rails, and sequentially advancing said shingle support member along said rails at said slots and laying a row of shingles at each location of said shingle support member such that the bottom edge of the row abuts said shingle support member.

14. Method according to claim 13 wherein said step of swingably mounting said shingle support member includes orienting said shingle support member such that said shingle support member extends beneath a row of shingles to support the shingles in said row from below.

15. Method according to claim 13 wherein said step of sequentially advancing said shingle support member includes swinging said shingle support member so as to slidably release and clear the shingles in a row.

16. Method of laying shingles on the surface of a vertical wall having an obstacle such as a window casement, comprising:

positioning a pair of rails such that the rails are spaced from the surface, each rail having discrete openings at predetermined spaced locations therealong corresponding to a desired spacing between bottom edges of adjacent rows of shingles to be laid, swingably mounting a shingle support member on said rails, said shingle support member having spacer blocks secure thereto, spacing said shingle support member from said surface by said spacer blocks so as to clear said obstacle, laying a row of shingles on said surface on both sides of said obstacle such that the bottom edge of said row of shingles abuts said spacer blocks, sequentially advancing said shingle support member between successive predetermined spaced locations along said rails on each side of said obstacle and laying a row of shingles on each side of said obstacle at each location of said shingle support member such that the bottom edge of the row of shingles abuts said spacer blocks.

17. Fixture for use in laying shingles on the surface of a roof or vertical wall, comprising:

a pair of rails, each provided with discrete openings at predetermined spaced locations therealong, means for supporting each of said rails such that said rails are spaced from said surface, a pair of sliders, each slider being mounted on one of said rails to as to be slidably displaceable between said predetermined spaced locations therealong, means associated with each slider for locking the slider at a predetermined location along a rail, a pair of swing arms, each swing arm being pivotably coupled to one of said sliders, a shingle support member, and means for coupling the shingle support member to each of said swing arms such that the shingle support member is displaceable along the surface in predetermined increments corresponding to the spacing between said predetermined rail locations.

18. Fixture according to claim 17 wherein said means for locking a slider at said predetermined locations along the rail includes a spring-urged pin mounted on the slider and insertable in said openings in the rail.

19. Fixture according to claim 18 wherein the pin is provided with a beveled end portion for camming engagement with the edge of a rail opening.

20. Fixture according to claim 17 wherein said shingle support member is pivotably coupled to each of said swing arms.

21. Fixture for use in laying shingles on the surface of a roof or vertical wall, comprising:

a pair of rails, each provided with discrete openings at predetermined spaced locations therealong, means for supporting each of said rails such that said rails are spaced from said surface, a pair of swing arms, means for pivotably mounting each swing arm at said predetermined spaced locations along one of said rails, a shingle support member, and means for pivotably coupling said shingle support member to each of said swing arms such that the shingle support member is displaceable along the surface in predetermined increments corresponding to the spacing between said predetermined rail locations.

22. Fixture according to claim 21 wherein said shingle support member includes a channel member extending between said swing arms, and a pair of brackets secured to the channel member, each bracket being pivotably coupled to one of said swing arms.

23. Fixture according to claim 22 wherein said shingle support member includes a L-shaped member secured to the channel member for supporting the bottom edges of a row of shingles therealong.

24. Fixture according to claim 3 wherein each of said rails is provided with spaced slots therealong, and wherein said means for pivotably attaching said shingle support member to said rails includes a pair of swingable arms each having a pivot pin adapted to fit within a slot of a rail such that the arm is pivotably supported on the rail, each arm having means for securing said shingle support member thereto, whereby said swingable arms and shingle support member are swingable in unison between said first and second positions, and wherein said spring means includes a spring-urged member mounted on a swingable arm to as to bear against the rail on which the arm is mounted.

25. Fixture for use in laying shingles on the surface of a roof or vertical wall, comprising:

a pair of rails.

means for supporting each of said rails such that said rails are spaced from said surface, a pair of swing arms, each swing arm being mounted on a rail so as to pivot about an axis extending between said rails, a shingle support member coupled to each of said swing arms, and spring means for biasing said shingle support member towards said surface of said roof or vertical wall.

26. Fixture according to claim 25 wherein said spring means includes an arm pivotably coupled to a swing arm, and a spring urged push rod mounted on ®aid arm so as to bear against a rail on which the swing arm is mounted and thereby lock the shingle support member in position against the surface of said roof or vertical wall.

27. Fixture for use in laying shingles on the surface of a roof or vertical wall, comprising:

a pair of rails, each of said rails being provided with one or more rows of spaced openings, means for supporting each of said rails such that said rails are spaced from said surface, a pair of sliders, each slider being mounted on one of said rails so as to be slideably displaceable therealong, a slider having a cam finger disposed so as to be received by one or more rail openings, a pair of swing arms, each swing arm being pivotably mounted on one of said sliders, and a shingle support member coupled to each of said swing arms.

28. Fixture according to claim 27 wherein each of said sliders is provided with an ear, each of said swing arms being pivotably coupled to a slider ear.

29. Fixture according to claim 27 wherein each of said sliders is provided with a stud, each of said swing arms being pivotably mounted on a slider stud.

30. Fixture according to claim 27 wherein said cam finger is provided with a ramp for camming engagement with the edge of a rail opening.

31. Fixture for use in laying shingles on the surface of a roof or vertical wall, comprising:

a pair of rails, means for supporting each of said rails such that said rails are spaced from said surface, a pair of sliders, each slider being mounted on one of said rails so as to be slidably displaceable therealong, means associated with each slider for locking the slider at one or more positions along the rail, a pair of swing arms, each swing arm being pivotably coupled to one of said sliders, a shingle support member coupled to each of said swing arms, said means for locking a slider at said one or more positions along a rail including a spring-urged pin mounted on the slider and one or more openings in the rail for receiving the pin.

32. Fixture according to claim 31 wherein the pin is provided with a beveled end portion for camming engagement with the edge of a rail opening.

33. Fixture according to claim 31 wherein said shingle support member is pivotably coupled to each of said swing arms.

* * * * *